US005101707A

United States Patent [19]

Kondo

[11] Patent Number: 5,101,707

[45] Date of Patent: Apr. 7, 1992

[54] AUTOMATIC PERFORMANCE APPARATUS OF AN ELECTRONIC MUSICAL INSTRUMENT

[75] Inventor: Masao Kondo, Hamamatsu, Japan

[73] Assignee: Yamaha Corporation, Hamamatsu, Japan

[21] Appl. No.: 649,165

[22] Filed: Feb. 1, 1991

Related U.S. Application Data

[63] Continuation of Ser. No. 321,227, Mar. 8, 1989, abandoned.

[30] Foreign Application Priority Data

Mar. 8, 1988 [JP] Japan ..... 63-30510[U]

[51] Int. Cl.[5] ..... G10H 1/38; G10H 7/00

[52] U.S. Cl. ..... 84/613; 84/637; 84/DIG. 22

[58] Field of Search ..... 84/609-614, 84/634-638, DIG. 12, DIG. 22

[56] References Cited

U.S. PATENT DOCUMENTS 4,315,451 2/1982 Uchiyama et al. ..... 84/DIG. 22

4,561,338 12/1985 Ohno ..... 84/DIG. 22

FOREIGN PATENT DOCUMENTS 60-163094 8/1985 Japan .

*Primary Examiner*—Stanley J. Witkowski

*Attorney, Agent, or Firm*—Spensley Horn Jubas & Lubitz

[57] ABSTRACT

The present invention relates to an automatic performance apparatus of an electronic musical instrument for activating and deactivating an automatic performance for each musical part such as melody tone, accompaniment tone, or rhythm tone. The first performance data memory stores an instruction signal which instructs the second reading circuit to start and stop reading performance data stored in the second performance data memory, so that the reading of the performance data stored in the second performance data memory can automatically start and stop in accordance with the progressing of the reading based on the performance data stored in the first performance data memory. Both performance data stored in the first performance data memory and in the second performance data memory are read by respective reading circuits, so that it is possible to selectively start and stop reading the performance data stored in both the first performance data memory and the second performance data memory.

5 Claims, 3 Drawing Sheets

| | | | | ADDRESS |
|---|---|---|---|---|
| TONE COLOR(PIANO) | RGS | | RGD | 0 |
| C MAJOR (A WHOLE NOTE) | CCD | TPD | FTD | 1 |
| F MAJOR (A HALF NOTE) | CCD | TPD | FTD | 2 |
| MELODY(ON) | RGS | | RGD | 3 |
| G MAJOR(A QUATER NOTE) | CCD | TPD | FTD | 4 |
| | | | | |
| D MINOR(A QUATER NOTE) | CCD | TPD | FTD | |
| MELODY(OFF) | RGS | | RGD | K |
| E MAJOR(HALF NOTE) | CCD | TPD | FTD | |
| | | | | |
| END | RGS | | RGD | N |

CM

AUTOMATIC PERFORMANCE APPARATUS OF AN ELECTRONIC MUSICAL INSTRUMENT

This is a continuation of copending application Ser. No. 07/321,227 filed on Mar. 8, 1989, now abandoned.

BACKGROUND OF THE INVENTION

1. Field of the Invention

The present invention relates to an automatic performance apparatus of an electronic musical instrument capable of activating and deactivating automatic performance for each musical part such as melody tone, accompaniment tone, or rhythm tone.

2. Prior Art

A conventional performance apparatus is disclosed in Japanese Patent Application Laid-Open Publication No. 60-163094. This conventional apparatus provides a memory, a reading control circuit, and an on-off control switch in each musical part, so that each on-off control switch controls the automatic performance of a separate musical part.

The above conventional apparatus reads out musical tone data stored in memory based on a common address counter, in which the memory is arranged for each musical part. Hence, the on-off control switch of the apparatus can control the musical tone data for either outputting or not, but the reading of the musical tone data stored in the memory progresses even though the reading of the musical tone data is stopped. Problems may arise, for example, because the conventional apparatus cannot start the performance at the beginning of the second musical part after a certain time delay from the first musical part.

SUMMARY OF THE INVENTION

It is accordingly an object of the present invention to provide an automatic performance apparatus of an electronic musical instrument capable of automatically activating and deactivating automatic performance based on one musical part in accordance with the other musical part, the performance of which is already in progress.

It is another object of the present invention to provide an auto-performance apparatus of an electronic musical instrument capable of beginning and ending the automatic performance of each musical part in accordance with selective timings.

In a first aspect of the present invention, there is provided an automatic performance apparatus comprising: first automatic performance means having first performance data memory and first reading means, wherein said first reading means reads out performance data stored in said first performance data memory; second automatic performance means having second performance data memory and second reading means, wherein said second reading means reads out performance data stored in said second performance data memory; whereby an instruction signal for reading out performance data stored in said first performance data memory, said instruction signal instructs said second reading means to start and stop reading performance data stored in said second performance data memory.

In a second aspect of the present invention, there is provided an automatic performance apparatus comprising: first automatic performance means having first performance data memory and first reading means, wherein said first reading means reads out performance data stored in said first performance data memory; second automatic performance means having second performance data memory and second reading means, wherein said second reading means reads out performance data stored in said second performance data memory; selection means for selecting at least either said first automatic performance means or said second automatic performance means in accordance with the state of an instruction signal.

BRIEF DESCRIPTION OF THE DRAWINGS

The present invention is described in the following; reference is made to the accompanying drawings wherein a preferred embodiment of the invention is shown.

DESCRIPTION OF THE PREFERRED EMBODIMENT

Hereinafter, an embodiment of the present invention will be described by reference to the drawings.

Figure 1:
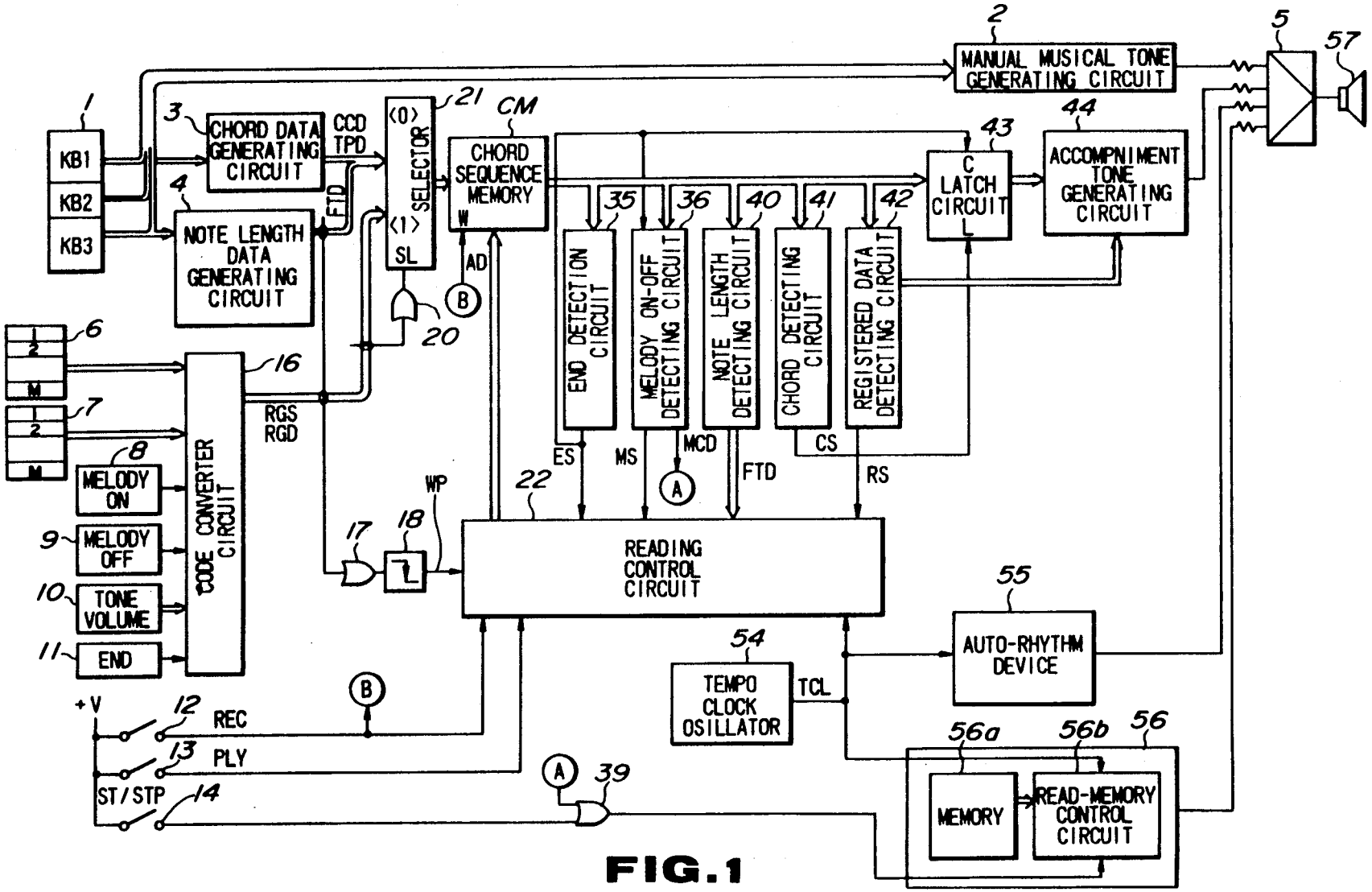
FIG. 1 is a block diagram showing a hardware construction of the automatic performance apparatus of an electronic musical instrument according to an embodiment of the present invention.

FIG. 1 is a block diagram showing the hardware construction of the present invention. In FIG. 1, numeral 1 designates a keyboard having plural keys, each of which provides key switches thereunder to detect the OPEN or CLOSED state thereof. The keyboard 1 is divided into three key-areas, KB1 to KB3, in which the output signal of each key in the key-area KB1 is supplied to a manual performance musical tone generating circuit 2 and a chord data generating circuit 3. The output signal of each key in the key-area KB2 is supplied to manual performance musical tone generating circuit 2, and the output signal of each key in the key-area KB3 is supplied to manual performance musical tone generating circuit 2 and note length data generating circuit 4 respectively.

The manual performance musical tone generating circuit generates a musical tone signal corresponding to the depressed key on keyboard 1 and outputs this musical ton signal to an amplifier 5. The chord data generating circuit detects the depressed key in key-area KB1 to generate its chord data in accordance with the detected key data, in which chord data indicates a chord of an accompaniment tone.

In the present embodiment, many types of chords such as C major or A minor are designated by the key operation of key-area KB1. For example, depressing keys C, E, and G of key-area KB1 designates C major. The chord data generating circuit 3 receives a signal based on the key which is depressed in key-area KB1. According to this received signal, the chord data generating circuit 3 generates chord data which includes basic tone data CCD indicated by the basic tone of the chord (C, D, E, or the like) and type data TPD indicated by type of the chord (major minor, or the like). In accordance with the generated chord data, an automatic accompaniment tone is generated as described later. The note length data generating circuit 4 generates note length data FTD corresponding to the depressed key in key-area KB3. Herein, the note length data of the accompaniment chord is indicated by the key operation of key-area KB3. The note length data generating circuit 4 then outputs note length data FTD to the next circuit in accordance with the detected key data of key-area KB3.

A tone color switch 6 is used for setting the tone color of the accompaniment tone; an effect switch 7 for setting an effect of the accompaniment tone; a melody-ON switch 8 for storing a starting signal of a melody tone in the automatic performance; a melody-OFF switch 9 for storing a stopping signal of the melody tone in the automatic performance; a multi-stage tone volume switch 10 is used for controlling the volume of the accompaniment tone; and an end switch 11 is used to indicate the completion of the accompaniment tone.

Numeral 12 designates a record switch which is CLOSED when writing data to chord sequence memory CM. A play switch 13 CLOSES when reading data stored in chord sequence memory CM to automatically perform the accompaniment tone. A start-stop switch 14 manually turns the melody tone on and off during the automatic performance.

A code converter circuit 16 generates the registered data corresponding to one of the operated switches 6 to 11. The registered data includes registered type data RGS and registered content data RGD, in which registered type data RGS indicates a type (tone color switch, effect switch, etc.) of the operated switch, while registered content data RGD indicates a switch number, a tone volume level (when tone volume switch 10 is operated), or the like. Numeral 17 designates an OR gate which executes the logical OR among the above-mentioned note length data FTD, registered data RGS, and RGD by every bit to thereby output its result to a differentiation circuit 18. The differentiation circuit 18 outputs a pulse signal to the next circuit when the output of OR gate 17 is a trailing edge.

Numeral 20 designates an OR gate for executing the logical OR among registered data RGS and RGD.

Numeral 21 designates a selector for selectively outputting the data at an input terminal <1>or <0>from the output terminal thereof depending on whether the output of OR gate 20 is "1" or "0".

A chord sequence memory CM stores basic tone data CCD, type data TPD, note length data FTD, and registered data RGS and RGD, in which basic tone data CCD and type data TPD are inputted from chord data generating circuit 3, the note length data is inputted from note length data generating circuit 4, and registered data RGS and RGD are inputted from code converter circuit 16. Further, chord sequence memory CM executes the reading or writing operation when receiving address data AD from reading control circuit 22. At this time, the chord sequence memory CM is in the writing mode when recording switch 12 is CLOSED, while it is in the reading mode when recording switch 12 is OPEN. An example of the memory contents in chord sequence memory CM is shown in FIG. 2.

Figures 2, 3:
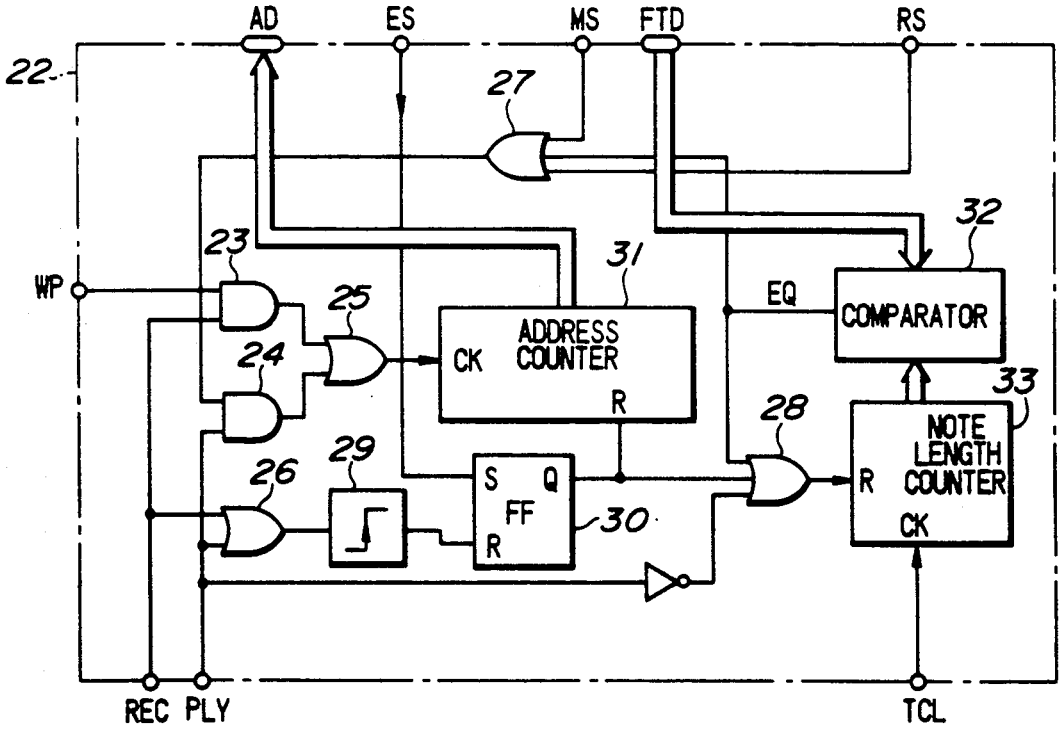
FIG. 2 is a layout diagram showing the data stored in a chord sequence memory CM shown in FIG. 1.
FIG. 3 is a block diagram showing the details of a reading control circuit 22 in this embodiment.

In FIG. 3, the reading control circuit 22 comprises AND gates 23 and 24, OR gates 25, 26, 27, and 28, a flip-flop circuit 30, an address counter 31, a comparator circuit 32, a note length counter 33, and a differentiation circuit 29 for differentiating a leading edge of signal inputted from OR gate 26. The operation of reading control circuit 22 will be described later.

In FIG. 1, an end detecting circuit 35 detects registered data RGS and RGD inputted from chord sequence memory CM to output an end signal ES to the next circuit, in which registered data RGS and RGD indicate the state of end switch 11.

Figure 4:
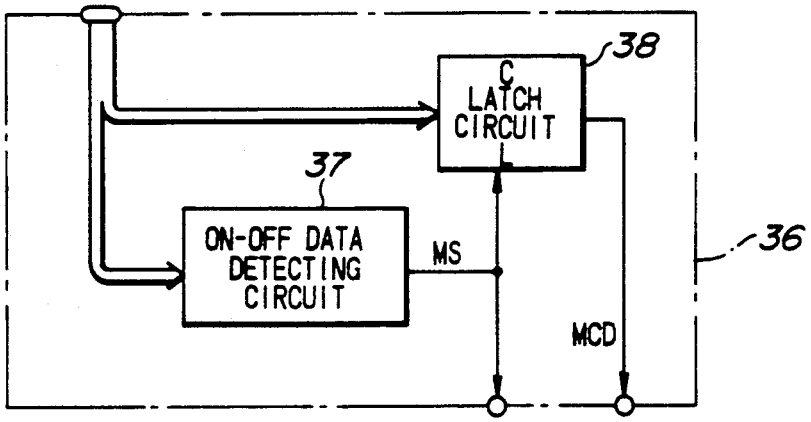
FIG. 4 is a block diagram showing a hardware construction of a melody on-off detecting circuit 36 shown in FIG. 1.

In FIG. 4, a melody on-off detecting circuit 36 includes an on-off data detecting circuit 37 and a latch circuit 38. The on-off data detecting circuit 37 detects registered type data RGS indicating the state of either melody-ON switch 8 or melody-OFF switch 9. The latch circuit 38 stores registered content data RGD based on detecting signal MS inputted from on-off data detecting circuit 37. The least significant digit of registered content data RGD stored in latch circuit 38 is outputted to OR gate 39 (shown in FIG. 1) as an on-off control signal MCD. At this time, the least significant digit of registered content data RGD corresponding to melody-ON switch 8 is "1", while the least significant digit of registered content data RGD corresponding to melody-OFF switch 9 is "0".

A note length detecting circuit 40 stores note length data FTD into an incorporated latch circuit to output note length data FTD to reading control circuit 22 when note length data FTD is inputted from chord sequence memory CM. A chord detecting circuit 41 detects the chord data, i.e., basic tone data CCD and type data TPD inputted from chord sequence memory CM. The chord detecting circuit 41 outputs a chord detecting signal CS (pulse signal) to latch circuit 43. When the latch circuit 43 receives chord detecting signal CS, it reads the chord data from chord sequence memory CM and the read chord data is outputted to an accompaniment tone generating circuit 44.

Figure 5:
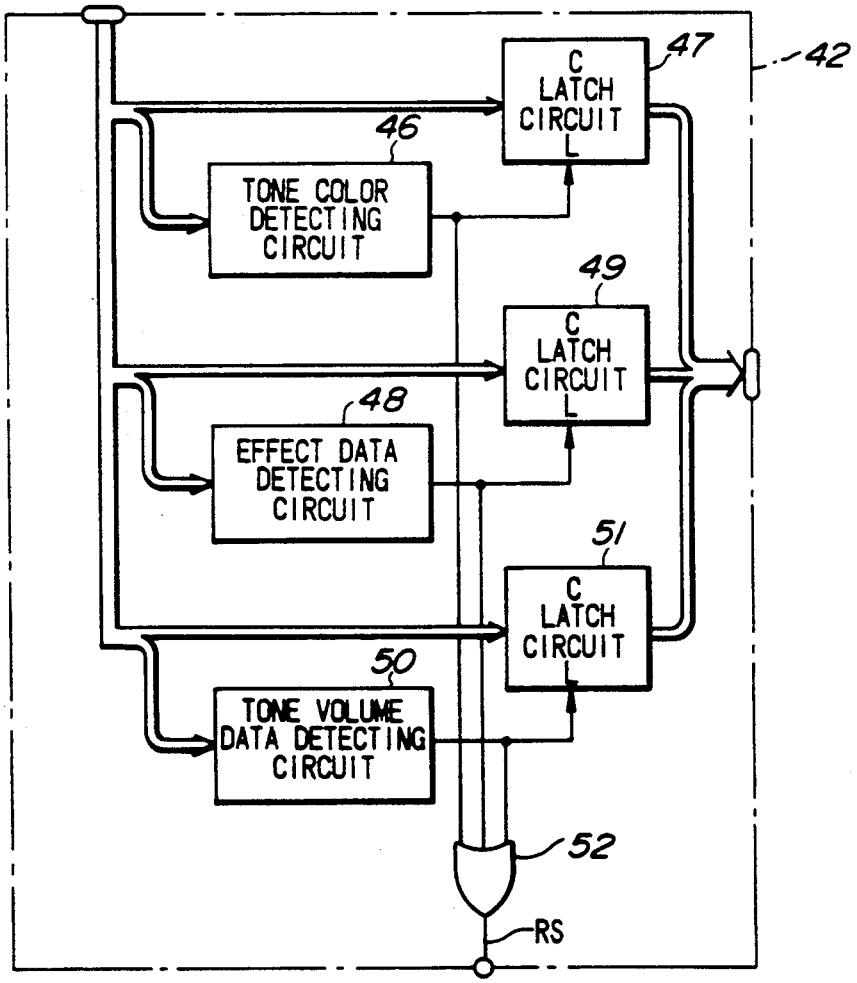
FIG. 5 is a block diagram showing the details of a registered data detecting circuit 42 shown in FIG. 1.

In FIG. 5, a registered data detecting circuit 42 comprises a tone color data detecting circuit 46, a latch circuit 47, an effect data detecting circuit 48, a latch circuit 49, a tone volume data detecting circuit 50, a latch circuit 51, and an OR gate 52. The tone color data detecting circuit 46 detects registered type data RGS indicating the state of tone color switch 6. The latch circuit 47 receives and stores registered content data RGD when tone color data detecting circuit 46 detects a detecting signal. The effect data detecting circuit 48 detects registered type data RGS indicating the state of effect switch 7. The latch circuit 49 stores registered content data RGD. The tone volume data detecting circuit 50 detects registered type data RGS indicating the state of tone volume switch 10. The latch circuit 51 stores registered content data RGD by inputting the detecting signal from tone volume data detecting circuit 50. The OR gate 52 executes the logical OR among the output signal of tone color data detecting circuit 46, effect data detecting circuit 48, or tone volume data detecting circuit 50 by every bit. Thus, each output data from the latch circuit 47, 49, and 51 is supplied to accompaniment tone generating circuit 44, then, the output signal of OR gate 52 is supplied to reading control circuit 22 as a signal RS.

The accompaniment tone generating circuit 44 generates an accompaniment tone signal whose tone color, effect, and tone volume respectively corresponds to tone color data, effect data, and tone volume data each outputted from registered data detecting circuit 42, in which accompaniment tone signal designates the accompaniment tone of a chord indicated by basic tone data CCD and type data TPD both supplied from latch circuit 43. Then, the accompaniment tone generating circuit 44 outputs its accompaniment tone signal to amplifier 5.

A tempo clock oscillator 54 generates a tempo clock TCL by which the tempo is generated. An autorhythm device 55 generates a rhythm tone signal of a waltz, mambo, or the like by operating the rhythm tone source incorporated therein. The auto-rhythm device 55 outputs its rhythm tone signal to amplifier 5. A melody auto-performance device 56 includes a memory $56_a$ and a read-memory control circuit $56_b$, in which memory $56_a$ stores performance data for automatically performing the melody tone, the read-memory control circuit $56_b$ reads the melody tone data stored in memory $56_a$ and then converts the data into a musical tone signal, then outputs its musical tone signal to the next circuit. Thus, the melody tone signal which is outputted from read-memory control circuit $56_b$ is supplied to amplifier 5. The amplifier 5 mixes each musical tone signal inputted from manual musical tone generating circuit 2, accompaniment tone generating circuit 44, auto-rhythm device 55, and melody auto-performance device 56. This amplifier 5 amplifies the mixed musical tone signal and then outputs its amplified signal to speaker 57.

Next, the operation of the auto-performance apparatus is described in accordance with the above-described construction.

(1) WRITING DATA INTO THE CHORD SEQUENCE MEMORY CM

In the case where data is written into chord sequence memory CM, the record switch 12 is turned on. Turning on record switch 12 produces signal REC of "1", which causes chord sequence memory CM to be set in the writing mode. When the REC signal "1" is supplied to differentiation circuit 29 through OR gate 26 shown in FIG. 3, the differentiation circuit 29 generates a pulse signal to supply its signal to the reset terminal R of flip-flop circuit 30. Therefore, the flip-flop circuit 30 is reset, and subsequently, a signal "0" from the output terminal of flip-flop circuit 30 is supplied to the reset terminal of address counter 31, thus, the reset state of the address counter 31 is released to permit the count. At this time, the address counter 31 is "0". Conversely, the AND gate 23 (shown in FIG. 3) opens when signal REC is "1".

Thereafter, when an operator uses one of switches 6 to 11, or the keys in key-areas KB1 and KB3, the data which correspond to the operated switches or the keys are, in turn, written into chord sequence memory CM. Hereinafter, an example of the written data is described as shown in FIG. 2. By depressing a switch indicative of a piano tone within tone color switches 6, registered type data RGS and registered content data RGD are outputted from code converter circuit 16, in which registered type data RGS indicates the state of tone color switch 6 and registered content data RGD indicates the piano tone. Outputting these registered data RGS and RGD turns the output of OR gate 20 into "1", thus, registered type data RGS and registered content data RGD are supplied to chord sequence memory CM through selector 21. At this time, the address data AD which is "0" is already supplied to chord sequence memory CM, registered type data RGS and registered content data RGD are written into the address 0 of chord sequence memory CM. Similarly, outputting the registered data RGS and RGD from code converter circuit 16 turns the output of OR gate 17 into "1". Then, by releasing the tone color switch 6, the output of code converter circuit 16 becomes "0", thus, the output of OR gate 17 becomes "0". When the output of OR gate 17 falls to "0", a pulse signal WP is generated in differentiation circuit 18, so that this pulse signal WP is supplied to clock terminal CK of address counter 31 through AND gate 23 and OR gate 25 as shown in FIG. 3. Thus, the address counter 31 counts up so that its output becomes "1", and this output is supplied to chord sequence memory CM as address data AD.

Next, when the operator operates the keys in key-area KB1 to key in C major chord, basic tone data CCD and type data TPD of C major are outputted from chord data generating circuit 3. Then, when the operator operates keys in key-area KB3 to key in the note length of all musical scales, this note length data FTD indicative of the note length of all musical scales, is outputted from note length data generating circuit 4. At this time, the output data of chord converter circuit 16 is "0", while the output data of OR gate 20 is "0" as well. As a result, basic tone data CCD, type data TPD, and note length data FTD are supplied to chord sequence memory CM through selector 21 to be written into the address 1 of chord sequence memory CM, in which basic tone data CCD and type data TPD are outputted from chord data generating circuit 3 and note length data FTD from note length data generating circuit 4. Next, when the operator operates the keys in key-area KB1 and KB3 to enter F major chord and a note length of a half note, these inputted chord and note length in which basic tone data CCD, type data TPD, and note length data FTD are written into the address 2 of chord sequence memory CM as the above. Then, by depressing the melody-ON switch 8, registered type data RGS and registered content data RGD are outputted from code converter circuit 16 and then written into the address g of chord sequence memory CM, in which registered data RGS and RGD correspond to the state of melody-ON switch 8.

(2) AUTOMATIC PERFORMANCE

The operation of the automatic performance is described in accordance with an example of the data which is stored in the chord sequence memory CM as shown in FIG. 2. In this case, record switch 12 is turned off and play switch 13 is turned on by the operator. By turning record switch 12 off, the chord sequence memory CM is changed into the reading mode. In contrast, by turning play switch 13 on, a signal PLY is changed to a "1" signal and AND gate 24 in FIG. 3 is changed to the open state, then, the output of OR gate 26 is risen "1". When the output of OR gate 26 is changed to "1", a pulse signal is outputted from differentiation circuit 29 at the leading edge of the output signal of OR gate 26 so that this pulse signal is supplied to the reset terminal R of flip-flop circuit 30. Thus, flip-flop circuit 30 is reset by the pulse signal, whereby a "0" signal is outputted from the output terminal Q of flip-flop circuit 30 and then supplied to the reset terminal R of address counter 31 and OR gate 28. As a result, the reset state of address counter 31 and the note length counter 33 are released to permit the count. Herein, the note length counter 33 counts the pulses from tempo clock TCL afterward.

At that time, the count of address counter 31 is "0", thus, address data AD having the value "0" is supplied to chord sequence memory CM. By supplying this address data AD to chord sequence memory CM, registered type data RGS and registered content data RGD are read and outputted from chord sequence memory CM. When outputting these registered data RGS and RGD from chord sequence memory CM, tone color data detecting circuit 46 (FIG. 5) incorporated in registered data detecting circuit 42 detects these registered data RGS and RGD to output its detecting signal to the next circuit. This makes registered content data RGD indicative of the piano tone to be stored into latch circuit 47, and this stored registered data RGD are outputted to accompaniment tone generating circuit 44, then, registered data RGD is set in accompaniment tone generating circuit 44. In addition, by outputting the detecting signal from tone color data detecting circuit 46, signal RS outputted from OR gate 52 is supplied to the clock terminal CK of address counter 31 through OR gate 27, AND gate 24, and OR gate 25. This sets the count of address counter 31 to "1", thus, address data AD is changed to "1".

By turning the address data AD into "1", data which is stored in the address 1 of chord sequence memory CM is read out, i.e., the chord data (the basic tone data CCD and type data TPD) of C major and note length data FTD of the whole note are read out. By reading out those chord data CCD and TPD of the C major from chord sequence memory CM, chord detecting circuit 41 detects chord data CCD and TPD to output its detecting signal CS to the load terminal L of latch circuit 43. This causes chord data CCD and TPD to be stored in latch circuit 43, and then these data are supplied to accompaniment tone generating circuit 44. By supplying the chord data CCD and TPD to accompaniment tone generating circuit 44, this accompaniment tone generating circuit 44 generates the accompaniment tone signal which is outputted to speaker 6 through amplifier 5, in which the accompaniment tone signal represents the piano tone of C major indicated by chord data CCD and TPD. Thus, the accompaniment tone of C major is generated based on the piano tone.

Outputting the tone length data FTD of the whole note from chord sequence memory CM, note length data detecting circuit 40 reads note length data FTD which is outputted to one input terminal of comparator circuit 32 as shown in FIG. 3. Afterward, the comparator circuit 32 compares note length data FTD with the count of note length counter 33. Now, after the interval of the whole note passes from the time when the note length data FTD of the whole note is outputted from chord sequence memory CM, the data indicative of the count of note length counter 33 (FIG. 3) is coincided with note length data FTD. Thus, a coincidence signal EQ (i.e., "1" signal) is outputted from comparator circuit 32. Supplying the coincidence signal EQ to clock terminal CK of address counter 31 through OR gate 27, AND gate 24 and OR gate 25, count value of address counter 31 becomes "2". This coincidence signal EQ is supplied to the reset terminal R of note length counter 33 through OR gate 28, which resets note length counter 33 so that the output thereof becomes "0". Therefore, coincidence signal EQ is returned to "0", afterward note length counter 33 again counts the pulses from tempo clock TCL.

Turning the count of address counter 31, i.e., address data AD into "2", data stored in the address 2 of chord sequence memory CM is outputted therefrom, in which the data stored in the address 2 represents chord data CCD and TPD of F major and note length data FTD of a half note. Then, the chord data CCD and TPD is stored in latch circuit 43, which generates the accompaniment tone of F major afterward and supplies note length data FTD of the half note &o comparator circuit 32 through note length data detecting circuit 40. When the interval of a half note passes from the time when chord data CCD and TPD, and note length data FTD are outputted from chord sequence memory CM, coincidence signal EQ is outputted from comparator circuit 32 This turns the value of address data AD into "3" and resets note length counter 33.

Turning the value of address data AD into "3", data stored in the address g of chord sequence memory CM is outputted therefrom, in which the data stored in the address g represents registered data RGS and RGD indicating the ON-state of the melody. By outputting the registered data RGS and RGD from chord sequence memory CM, on-off data detecting circuit 37 (FIG. 4) incorporated in melody on-off detecting circuit 36 detects registered data RGS and RGD, then outputs its detecting signal MS to the next circuit.

By outputting the detecting signal MS from melody data detecting circuit 37, this detecting signal MS is supplied to the load terminal L of latch circuit 38. At this time, the registered content data RGD is stored in latch circuit 38, then, its least significant digit ("1" in this case) is outputted to reading control circuit $56_b$ of melody auto-performance device 56 through OR gate 39 as melody control signal MCD. Thus, performance data stored in memory $56_a$ are, in turn, read out afterward, and then converted into the melody tone signal which is supplied to speaker 57 through amplifier 5, thus, the automatic performance of melody tone is played. Outputting detecting signal MS from on-off data detecting circuit 37, this detecting signal MS is supplied to address counter 31 through OR gate 27, AND gate 24, and OR gate 25, thus, the count of address counter 31 or address data AD becomes "4". Thus, the data stored in the address 4 of chord sequence memory CM is read out.

Thereafter, the above-mentioned process is repeated. Herein, turning the value of address data AD into "K", data stored in the address "K" of chord sequence memory CM is read out, in other words, registered data RGS and RGD indicating the OFF-state of the melody is read out. This makes detecting signal MS to output from on-off data detecting circuit 37 as shown in FIG. 4. By outputting the detecting signal MS from on-off data detecting circuit 37, registered content data RGD is stored in latch 38. This turns melody control signal MCD into "0" signal, then supplies this "0" signal to melody auto-performance device 56, thus, the automatic performance of the melody tone is stopped. Next, by outputting the detecting signal MS from on-off data detecting circuit 37, address counter 31 is incremented by "1".

Afterward, data stored in the chord sequence memory CM, is, in turn, read out therefrom. When the value of address data AD becomes "N", registered data RGS and RGD indicative of the data end are read out from chord sequence memory CM. By outputting this registered data RGS and RGD from chord sequence memory CM, end detecting circuit 35 detects this registered data RGS and RGD to thereby generate an end signal ES. This end signal ES is supplied to the clear terminal of latch circuit 38 incorporated in melody on-off detecting circuit 36, which clears latch circuit 38. In addition, the end signal ES is supplied to the clear terminal of latch circuit 43, which clears latch circuit 43. By clearing the latch circuit 43, the generation of the accompaniment tone is stopped in accompaniment tone generating circuit 44. Further, end signal ES is supplied to the set terminal S of flip-flop circuit 30 (FIG. 3), which causes flip-flop circuit 30 to change to the set state. By setting flip-flop circuit 30, a signal "1" is supplied to each of the reset terminals R of address counter 31 and note length counter 33. This resets address counter 31 and note length counter 33, then the automatic performance is eventually completed.

On the other hand, when the on-off control signal MCD is changed to "0" while start-stop switch 14 is closed, a signal is supplied to read-memory control circuit $56_b$ incorporated in melody auto-performance device 56 through OR gate 39. This reads performance data stored in memory $56_a$, and converts this performance data into the melody tone signal. This melody tone signal is supplied to speaker 57, whereby the automatic performance is played based on the melody tone data.

In the present embodiment described heretofore, reading control circuit 22 and read-memory control circuit $56_b$ can independently read musical tone data store in chord sequence memory CM and memory $56_a$ respectively. Hence, it is possible to selectively control the beginning and end of the musical performance, the musical tone data of which is outputted from chord sequence memory CM and memory $56_a$. In addition, musical tone data stored in memory $56_a$ can be outputted in accordance with the state of melody control signal MCD which is based on registered data RGD stored in chord sequence memory CM. Hence, it is possible to automatically control the beginning and end of the musical performance, musical tone data of which corresponds to the progress of the musical performance based on the musical tone data in chord sequence memory CM.

The above is the description of the preferred embodiment of the present invention. This invention may be practiced or embodied in other ways without departing from the spirit or essential character thereof. For example, the present embodiment can be modified as in the following examples.

Plural memories may be provided, instead of memory $56_a$. Therefore, each timing data for turning the melody tone on and off such as the data in the address 3 and the address K shown in FIG. 2 can be stored in the chord sequence memory CM corresponding to each memory.

If two memories are provided, the timing data for turning the melody on and off based on the melody tone data stored in the first memory can be stored in the chord sequence memory CM while the timing data for turning the melody on and off based on the melody tone data stored in the second memory can be stored in the first memory.

A memory for a base tone can be provided instead of the memory for the melody; the memory thereby stores the base tone data. This timing data for turning the base tone on and off based on the base tone data can be stored in chord sequence memory CM.

Two memories for melody tone can be provided instead of the chord sequence memory CM. The timing data for turing the melody on and off based on the melody tone data stored i one memory can be stored in the other memory.

Three or more memories can be provided for melody tone. In this case, one memory can store the timing data for turning melody on and off based on the melody tone data stored in the other two memories.

The chord sequence memory CM and two memories for melody tone can be provided, in which the chord sequence memory CM stores the timing data for turning the melody on based on the melody tone data stored in first memory, the first memory stores the timing data for turing melody on based on the melody tone data stored in second memory, and the second memory stores the timing data for turning melody off based on the melody tone data stored in the first memory.

Therefore, the preferred embodiment described herein is illustrative and not restrictive, the scope of the invention being indicated by the appended claims and all variations which come within the meaning of the claims are intended to be embraced therein.

We claim:

1. An automatic performance apparatus of an electronic musical instrument comprising:

first automatic performance means for performing music comprising:

first memory means for storing first performance information and instruction information; and first reading means for reading said first performance information and said instruction information from said first memory means;

second automatic performance means for performing music comprising:

second memory means for storing second performance information; and second reading means for reading said second performance information from said second memory means; and control means for controlling said second automatic performance means in response to the readout of said instruction information.

2. An automatic performance apparatus according to claim 1, wherein said first memory means comprises a chord sequence memory for storing said first performance information including basic tone data.

3. An automatic performance apparatus of an electronic musical instrument comprising:

first automatic performance means having a first performance data memory for storing first performance data and first reading means for reading out performance data stored in said first performance data memory;

second automatic performance means having a second performance data memory for storing second performance data and second reading means for reading out performance data stored in said second performance data memory; and selection means for selecting at least one of said first automatic performance means and said second automatic performance means in accordance with the state of stored instruction data, said selection means comprising a start-stop switch and said stored instruction data comprising registered content data included in said first performance data memory.

4. An automatic performance apparatus of an electronic musical instrument comprising:

first automatic performance means having a first performance data memory for storing first performance data and first reading means for reading out performance data stored in said first performance data memory;

second automatic performance means having a second performance data memory for storing second performance data and second reading means for reading out performance data stored in said second performance data memory; and selection means for selecting at least one of said first automatic performance means and said second automatic performance means in accordance with the state of stored instruction data, wherein said first performance data memory is a chord sequence memory for storing said first performance data including basic tone data.

5. An automatic performance apparatus of an electronic musical instrument comprising:

first automatic performance means having a first performance data memory for storing first performance data and first reading means for reading out performance data stored in said first performance data memory;

second automatic performance means having a second performance data memory for storing second performance data and second reading means for reading out performance data stored in said second performance data memory; and selection means for selecting at least one of said first automatic performance means and said second automatic performance means in accordance with the state of stored instruction data, wherein at least one of said first memory and said second memory stores said instruction data.

* * * * *